US005918096A

United States Patent [19]

Sano et al.

[11] Patent Number: 5,918,096

[45] Date of Patent: Jun. 29, 1999

[54] IMAGE TRANSFER APPARATUS

[75] Inventors: Tetsuya Sano, Numazu; Koichi Tanigawa, Mishima; Hideo Nanataki, Tokyo; Atsuyoshi Abe, Susono, all of Japan

[73] Assignee: Canon Kabushiki Kaisha, Tokyo, Japan

[21] Appl. No.: 08/803,101

[22] Filed: Feb. 20, 1997

[30] Foreign Application Priority Data

Feb. 23, 1996 [JP] Japan ..... 8-036532

[51] Int. Cl.[6] ..... G03G 15/16

[52] U.S. Cl. ..... 399/314; 361/225; 399/316

[58] Field of Search ..... 399/314, 316, 399/317, 303, 310, 297, 66, 148, 168, 174; 361/225, 214

[56] References Cited

U.S. PATENT DOCUMENTS

| | | | |
|---|---|---|---|
| 3,832,053 | 8/1974 | Goel et al. | 399/314 X |
| 3,879,121 | 4/1975 | Simpson | 399/314 X |
| 4,098,227 | 7/1978 | Thompson | 399/310 |
| 4,114,536 | 9/1978 | Kaneko et al. | 399/316 X |
| 5,081,501 | 1/1992 | Waki et al. | 399/303 |
| 5,412,460 | 5/1995 | Okazaki et al. | 399/310 |
| 5,594,538 | 1/1997 | Takekoshi et al. | 399/310 |
| 5,697,033 | 12/1997 | Ichikawa et al. | 399/310 |

FOREIGN PATENT DOCUMENTS

| | | |
|---|---|---|
| 6-149078 | 5/1994 | Japan . |
| 6-175509 | 6/1994 | Japan . |
| 7-092829 | 4/1995 | Japan . |

*Primary Examiner*—Shuk Lee
*Assistant Examiner*—Sophia S. Chen
*Attorney, Agent, or Firm*—Fitzpatrick, Cella, Harper & Scinto

[57] ABSTRACT

An image transfer apparatus has a transfer charging member for transferring a toner image from an image bearing member to a transfer material, the transfer charging member adapted to contact with a surface of the transfer material conveyed between the image bearing member and the transfer charging member opposite to a surface thereof facing the image bearing member, and a guide member for supporting the transfer charging member and to guide it between the image bearing member and the transfer charging member.

16 Claims, 12 Drawing Sheets

COMPARATIVE SAMPLE 1

COMPARATIVE SAMPLE 2

COMPARATIVE SAMPLE 3

COMPARATIVE SAMPLE 4

FIG. 4

| | SPLASH | | | EXPLOSION | | |
|---|---|---|---|---|---|---|
| | BIAS VOLTAGE (V) | | | BIAS VOLTAGE (V) | | |
| | 500 | 1000 | 1500 | 500 | 1000 | 1500 |
| EMBODIMENT 1 | ○ | ○ | ○ | ○ | ○ | ○ |
| COMPARATIVE SAMPLE 1 | △ | △ | △ | × | △ | △ |
| COMPARATIVE SAMPLE 2 | △ | △ | △ | × | × | × |
| COMPARATIVE SAMPLE 3 | ○ | ○ | ○ | × | △ | △ |
| COMPARATIVE SAMPLE 4 | △ | △ | △ | ○ | ○ | ○ |

○: NO
△: EXIST (SMALL)
×: EXIST

FIG. 8

| | SPLASH | | | EXPLOSION | | |
|---|---|---|---|---|---|---|
| | BIAS VOLTAGE (V) | | | BIAS VOLTAGE (V) | | |
| | 500 | 1000 | 1500 | 500 | 1000 | 1500 |
| EMBODIMENT 1 | ○ | ○ | ○ | ○ | ○ | ○ |
| COMPARATIVE SAMPLE 1 | △ | △ | △ | × | △ | △ |
| DEFORMED SAMPLE 1 | ◎ | ◎ | ◎ | ○ | ○ | ○ |
| DEFORMED SAMPLE 2 | ◎ | ◎ | ◎ | ○ | ○ | ○ |

◎: NO (GOOD)
○: NO
△: EXIST (SMALL)
×: EXIST

FIG. 13A
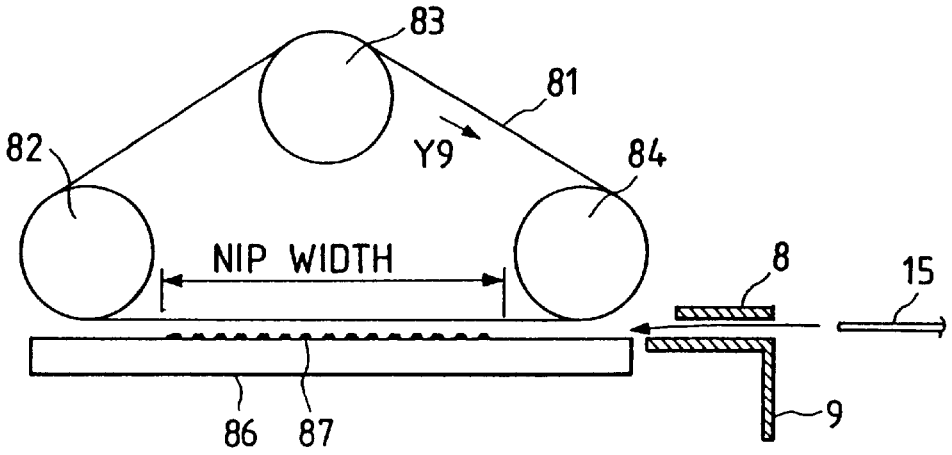
FIG. 13B
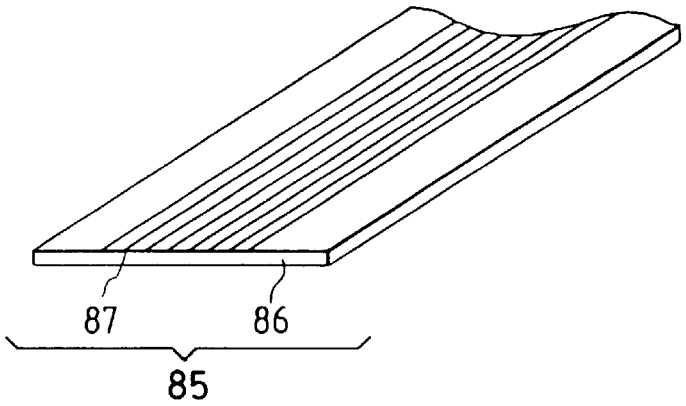
FIG. 14
BAD TRANSFER
| | PROCESS SPEED (mm/s) | | | | |
|---|---|---|---|---|---|
| | 50 | 100 | 200 | 300 | 500 |
| EMBODIMENT 6 | ○ | ○ | ○ | ○ | ○ |
| COMPARATIVE SAMPLE 1 | ○ | ○ | ○ | △ | △ |

IMAGE TRANSFER APPARATUS

BACKGROUND OF THE INVENTION

1. Field of the Invention

This invention relates to a transfer apparatus having a transfer charging member for transferring a toner image from an image bearing member to a transfer material (recording material).

This invention particularly relates to a transfer apparatus in an image forming apparatus such as an electrophotographic copying apparatus, an electrophotographic printer or an electrophotographic facsimile apparatus, and a device for transferring a toner image directly or indirectly formed on the surface of an image bearing member by the use of a charged toner by suitable image forming process means such as electrostatic recording or magnetic recording to the surface of a recording material.

2. Related Background Art

Heretofore, for example, in an image forming apparatus of the electrophotographic type or an image forming apparatus of the electrostatic recording type, a corona transfer apparatus has been used as transfer means for transferring a toner image formed or an image bearing member such as a photosensitive member to a recording material such as sheet. This corona transfer apparatus is disposed a relationship with the recording material and utilizes corona discharge to impart a predetermined charge to the recording material and transfer the toner image on the image bearing member to the recording material, and is effective as a non-contact transfer means. However, it suffers from the problem that the application of a high voltage is necessary for the creation of corona discharge or that ozone is created during corona discharge. Therefore, in recent years, there has been developed an image forming apparatus using transfer means of the contact type capable of transferring an image by the application of a relatively low voltage. This transfer means of the contact type is generally provided with an electrically conductive roller or the like adapted to contact with the back of a recording material, and has a relatively low bias voltage applied thereto to thereby transfer a toner image on an image bearing member to the recording material. Since a low voltage can be applied to the transfer means of such contact type, a power source can be made compact and there is a merit such as a small amount of ozone is created.

FIG. 15 of the accompanying drawings is a schematic construction view of an image forming apparatus of the electrophotographic type for illustrating the prior art.

This image forming apparatus is provided with a photosensitive drum 1 rotatively driven in the direction of arrow Y1, and around it, there are disposed in succession along the direction of rotation thereof a charging roller (charging means) 2 for uniformly charging the surface of the photosensitive drum, an exposure device 3 for forming an electrostatic latent image conforming to image information on the photosensitive drum 1, a developing device 4 for causing a toner to adhere to the electrostatic latent image to thereby form a toner image, a transfer roller (transfer member) 5 for transferring the toner image on the photosensitive drum 1 to a recording material 15, a cleaner for removing any residual toner or the like on the photosensitive drum 1 after the transfer of the toner image, and a fixting device for fixing the toner image transferred onto the recording material 15.

The operation of this image forming apparatus will now be described. The surface of the photosensitive drum 1 is uniformly charged by the charging roller 2, whereafter it is subjected to exposure by scanning light conforming to image information from the exposure device 3 such as a laser scanner, whereby an electrostatic latent image is formed. This electrostatic latent image is developed into a toner image by a toner contained in the developing container **4*b* of the developing device 4 and carried in a layer-like form on the surface of a developing sleeve 4*a*. The recording material 15 set on a sheet supply tray 14 is supplied to the nip portion m between the photosensitive drum 1 and the transfer roller 5 by a conveying system including a sheet supply roller 13, register rollers 10, 11, conveyance guides 12*a*, 12*b*, transfer guides 8, 9, etc., and the toner image on the photosensitive drum 1 is transferred onto the recording material 15 by the action of the transfer roller. Thereafter, the recording material 15 is separated from the photosensitive drum 1 and is sent to the fixting device 7 through the conveyance guide 12*b*, whereby the transferred image is fixted and the recording material is discharged onto a sheet discharge tray 16. On the other hand, the photosensitive drum 1 continues its rotation, and adhering materials such as residual toner adhering to the surface thereof are removed by the cleaner 6**, and the photosensitive drum is used for the next image forming process.

The above-described transfer apparatus according to the prior art, however, has suffered from the following inconvenience. When in the above-described transfer apparatus, transfer is to be effected onto a recording material of relatively high resistance under an environment of e.g., low temperature (10° C.) and low humidity (10%), there occurs the inconvenience of a slight reduction in the quality of image by bad transfer called "explosion" and "splash" which will hereinafter be described.

The "explosion" is a phenomenon occurring when an sheet chiefly of high resistance is used under an environment of low temperature and low humidity, and is a bad transfer in which for example, on an image sample, a toner is scattered over a white portion around a solid black portion as if it were exploded, thereby reducing the image quality. This is considered to be because that the unfixted toner image once transferred onto the image is subjected to the influence of excess charges on the back of the transfer sheet and they mutually cause repulsion and the toner is scattered as if it were exploded. Also, the "splash" is a phenomenon in which the toner, when transferred, is not transferred to a predetermined position but splashes in any direction, and is bad transfer in which for example, on an image sample, the outline around a character portion becomes blurred to thereby disturb the character image or the like and reduce the quality of image.

Also, particularly in the case of the roller transfer type, it is necessary to go through a complicated process in the manufacture of a member and the cost becomes high and thus, a more inexpensive transfer apparatus is required.

SUMMARY OF THE INVENTION

It is an object of the present invention to provide a transfer apparatus which is free of bad image problems as described above and which can obtain a high quality of image.

It is another object of the present invention to provide a transfer apparatus which effects good transfer by a transfer charging member of inexpensive and simple construction.

Further objects and features of the present invention will become apparent from the following detailed description taken in conjunction with the accompanying drawings.

BRIEF DESCRIPTION OF THE DRAWINGS

FIG. 4 is a table showing the effects of the first embodiment of the present invention.

FIG. 8 is a table showing the effects of the second embodiment of the present invention.

FIGS. 13A and 13B are schematic cross-sectional views illustrating a fifth embodiment of the present invention.

FIG. 14 is a table showing the effects of the fifth embodiment of the present invention.

DESCRIPTION OF THE PREFERRED EMBODIMENTS

Figure 1A:
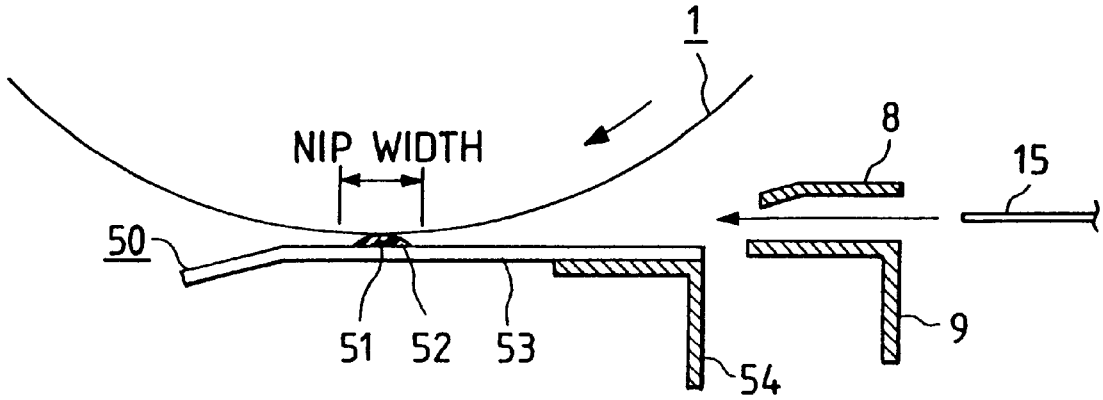
FIGS. 1A and 1B are schematic cross-sectional view illustrating a first embodiment of the present invention.

The general construction and operation of an image forming apparatus which can use the transfer apparatus of the present invention will hereinafter be briefly described with reference to FIG. 2.

The reference numeral 1 designates a cylindrical photosensitive drum (image bearing member) comprised chiefly of an electrically conductive base body 1*b* such as aluminum and a photoconductive layer 1*a* formed on the outer periphery thereof, and adapted to be rotatively driven in the direction of arrow Y1 by drive means (not shown). The reference numeral 2 denotes a charging roller (charging device) which uniformly charges the surface of the photosensitive drum 1 to a predetermined polarity and potential. The charging roller 2 has its lengthwise end portion biased by pressing means (not shown), and is urged against the photosensitive drum 1 with predetermined contact pressure, and is rotated in the direction of arrow Y2 with the rotation of the photosensitive drum 1 in the direction of arrow Y1. Also, the charging roller 2 has a bias voltage applied thereto by a voltage source (not shown) to thereby uniformly contact with and charge the surface of the photosensitive drum 1.

Exposure means 3 is disposed downstream of the charging roller 2 with respect to the direction of rotation of the photosensitive drum 1. The exposure means 3 selectively exposes the surface of the photosensitive drum in conformity with an image signal from an outside apparatus such as a computer or a word processor to thereby form an electrostatic latent image. Downstream of the exposure means 3, there is disposed a developing device 4 having a developing container 4*b* containing a toner therein and a developing sleeve for causing the toner to adhere to the electrostatic latent image. The toner charged to a predetermined polarity in the developing container 4*b* may be applied to the surface of the developing sleeve 4*a* with a predetermined thickness and be carried thereon by the rotation of the developing sleeve in the direction of arrow Y3, and in a developing position opposed to the surface of the photosensitive drum 1, the toner may shift from the developing sleeve 4*a* onto the photosensitive drum 1 and adhere to the electrostatic latent image on the photosensitive drum 1.

On the other hand, recording materials (second image bearing member) 15 set on a sheet supply tray 14 are supplied one by one by the driving of a sheet supply roller 13 and are fed to the nip portion (transfer portion) n between the photosensitive drum 1 and a transfer apparatus 50 bearing against it and having a transfer bias applied thereto, via a conveyance guide 12*a*, a pair of register rollers 10 and 11 and transfer guides 8 and 9, with appropriate timing synchronized with the rotation of the photosensitive drum 1, whereby the toner image on the surface of the photosensitive drum 1 is sequentially transferred to the surface of the transfer material 15. The recording material 15 passed through the transfer portion is separated from the surface of the drum 1, is introduced into a fixting device 7 by a conveyance guide 12*b* and is subjected to the fixting of the transferred toner image, and is outputted as an image forming article (print) onto a sheet discharge tray 16. After the separation of the recording material, the surface of the photosensitive drum 1 has any residual matter thereon such as untransferred toner or the like removed by a cleaning device 6 and is cleaned for repetitive image formation.

(First Embodiment)

A first embodiment of the transfer apparatus of the present invention will now be described in detail.

Figure 1B:
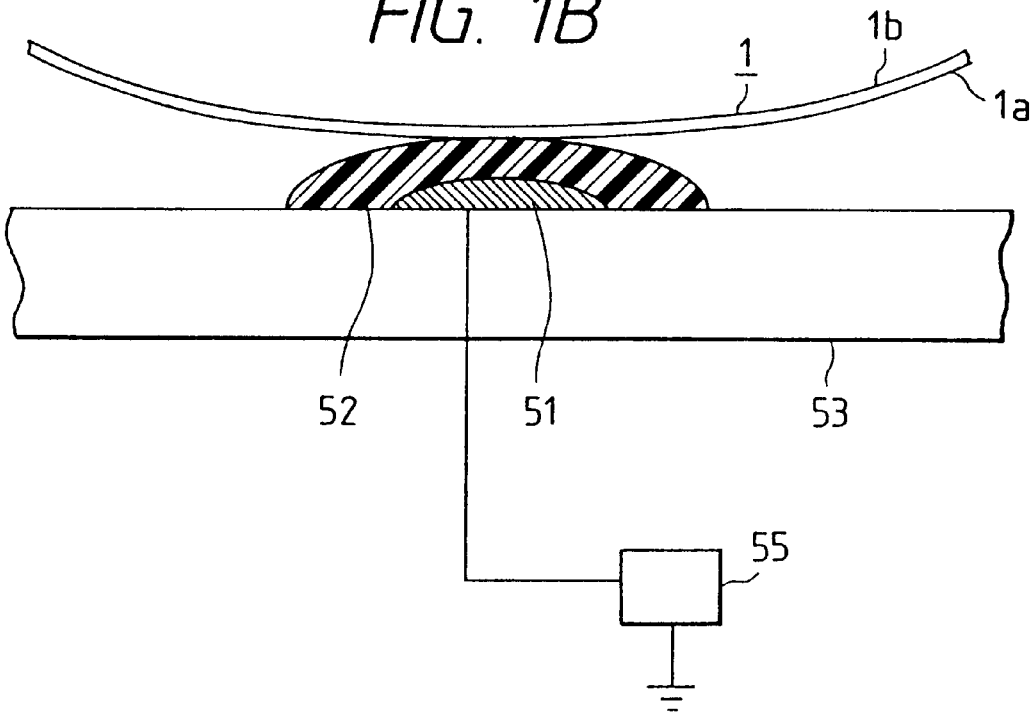

FIGS. 1A and 1B are cross-sectional views of a toner member 50 which is an embodiment of the present invention. This transfer member 50 comprises an electrically conductive metallic electrode 51 and a medium resistance member 52, and is further comprised of a sheet-like electrode holding member 53 utilizing its own flexure or the like to cause the transfer charging member to bear against the photosensitive drum, and a fixing member 54 for fixedly holding these on the apparatus body or the like. The reference numeral 51 designates a metallic electrode such as an Au-W wire or copper wire having a diameter of 0.5 mm, and the metallic electrode 51 is connected to an external power source 55 and a predetermined transfer bias is applied thereto. The medium resistance member 52 is a medium resistance member having a width of 0.5 to 2 mm in the direction of rotation of the drum and a thickness of 0.5 to 4 mm formed of resin and resistance-adjusted so that the resistance between the transfer surface and the power supply contact may be $10^3$ to $10^{12}$ Ω when a voltage of 500 V to 1.5 kV is applied to the electrode, and as the medium resistance member, use can be made of resin of nylon origin or resin of polystyrene origin having a filler such as carbon black or metal powder dispersed therein, or electrically conductive resin such as resin of ion electrically conductive origin, PA or PPP. The volume resistivity of the medium resistance member 52 may preferably be $10^4$ to $10^{13}$ Ω, and it is also possible to construct it of an electrically conductive resilient material satisfying the above-mentioned resistance value to enhance the contacting property with respect to sheet. The transfer charging member constituted by the electrode 51 and the medium resistance member 52 bears against the photosensitive drum with the transfer sheet interposed therebetween to thereby form a transfer nip, and in this portion, charges are supplied to the back of the sheet and the transfer of the toner image is effected. (Generally, the nip width differs depending on the diameter of the photosensitive drum, the kind of the medium resistance member, etc. and therefore the width of the electrode is not restricted to the above-mentioned value. The nip portion refers to the portion of contact between the drum and the transfer sheet, and in the present embodiment, the transfer charging member is provided in this nip portion.)

The reference numeral 53 designates a sheet-like electrode portion holding member of a thickness 100 to 200 μm formed of nylon or insulative resin such as PET (polyethylene terephthalate or fluorine resin, and the transfer charging member is formed as by the electrode 51 and the medium resistance member 52 being adhesively secured to or embedded in a portion corresponding to the portion bearing against the drum. Also, the transfer charging member has one end thereof attached to the fixing member 54 and is designed to utilize its own flexure or the like to cause the electrode portion 51 and the medium resistance member 52 to bear against the photosensitive drum with suitable contact pressure. This contact pressure is contact pressure per unit length in the nip portion, and may preferably be in the range of 0.3 g/cm to 10 g/cm, and in the present embodiment, it is 1.5 g/cm. Here, insulative resin is used as the sheet-like electrode holding member 53, but when a frictional charging history is to be imparted to the sheet, suitable resistance adjustment such as carbon dispersion can be effected to thereby construct a preferred holding member. Also, the sheet-like electrode holding member 53 has a role as a guide member for guiding the supplied sheet to the point of contact (transfer region) with the photosensitive drum 1. The holding member 53 may be made integral with the transfer lower guide 9.

As the confirmation of the effect of the present embodiment, image evaluation was done under low-temperature (10° C.) and low humidity (10%) environment. As shown in FIG. 3, with (a) comparative sample 1: a transfer roller, (b) comparative sample 2: a sheet-like transfer member having an electrode portion greater in width than the nip width from the upstream side to the downstream side with respect to the direction of rotation of the drum, (c) comparative sample 3: a sheet-like transfer member having an electrode portion greater in width than the nip width from the nip portion to the downstream side with respect to the direction of rotation of the drum, and (d) comparative sample (4): a sheet-like transfer member having an electrode portion greater in width than the nip width from the nip portion to the upstream side with respect to the direction of rotation of the drum used as comparative samples, image evaluations such as splash and explosion were done The transfer roller is comprised of a metallic mandrel 57 and a medium resistance layer 52, and the sheet-like transfer member is comprised of an electrically conductive sheet-like electrode 56 of a thickness 10 μm such as a metallic tape or an SUS sheet, a medium resistance member 52, an electrode holding member 53 and a fixing member 54.

For the medium resistance member 52 and the electrode holding member 53, use was made of the same materials as those in the present embodiment. Also, in comparative sample 2, a transfer charging member comprised of an electrode 56 and a medium resistance member 52 is disposed so as to be formed in the nip portion and the portions before and behind the nip portion; in comparative sample 3, a transfer charging member comprised of an electrode 56 and a medium resistance member 52 is disposed so as to be formed in the nip portion and the portion downstream of the nip portion; and in comparative sample 4, a transfer charging member comprised of an electrode 56 and a medium resistance member 52 is disposed so as to be formed in the nip portion and the portion upstream of the nip portion. Incidentally, as regards the resistance value, the resistance value $10^6$ Ω between the transfer surface and the power supply contact was used, and as regards the bias voltage, a constant voltage of 500 V to 1.5 kV was applied and compared. The transfer charging member may not be provided with the medium resistance member 52.

FIG. 4 shows a table of the result of image evaluation for each bias voltage. As can be seen from the table, in the case of comparative sample 1, splash exists (small) and explosion exists (small), in the case of comparative sample 2, splash exists (small) and explosion exists, in the case of comparative sample 3, there is no splash and explosion exists, and in the case of comparative sample 4, splash exists (small) and there is no explosion, whereas in the case of the present embodiment, there is no splash and there is no explosion, and this is good. This is considered to be because in the transfer charging member, the upstream side of the nip portion adversely affects the splash and the downstream side of the nip portion adversely affects the explosion. That is, in the upstream portion of the nip, charges imparted by the transfer charging member in the upstream portion adversely affects the toner image before transferred from the photosensitive member, and splash occurs; while and in the downstream portion of the nip, charges imparted by the transfer charging member in the downstream portion adversely affects the toner image after transferred to the sheet, and explosion occurs. In contrast, in the case of the narrow transfer charging member used in the present embodiment, there is no transfer problems charging portion in the upstream portion and the downstream portion and therefore, it is considered that there is obtained a good image free of bad transfer such as splash and explosion.

Accordingly, as in the present embodiment, transfer is effected by the use of a transfer charging member having a narrow electrode in the nip portion, whereby the imparting of charges to the transfer material in any other portion than the nip portion can be eliminated, and therefore it becomes possible to prevent bad transfer problems such as explosion and splash to thereby effect a good transfer of high resolving power.

Figure 2:
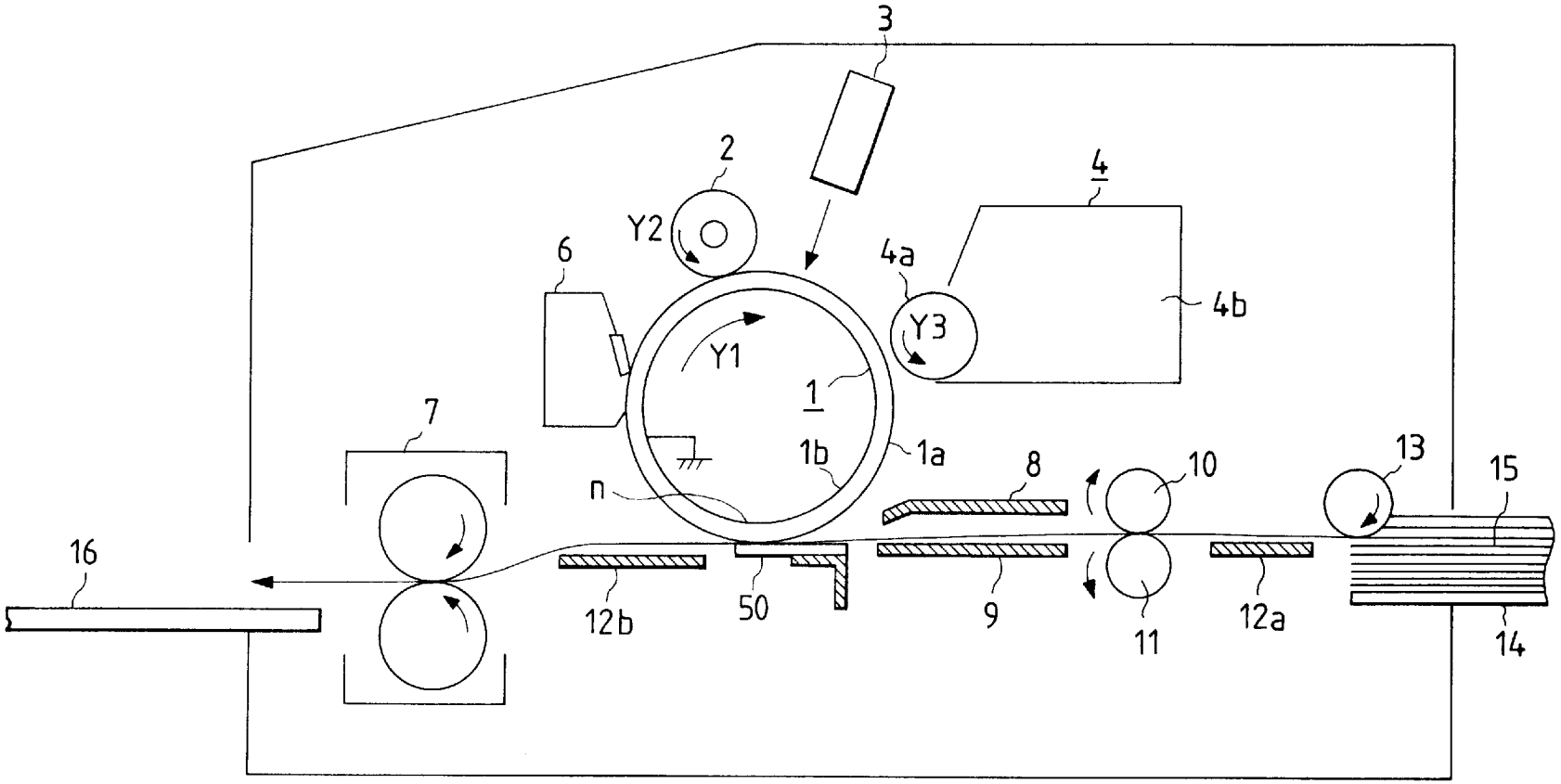
FIG. 2 is a schematic cross-sectional view illustrating the first embodiment of the present invention.
Figure 3A:
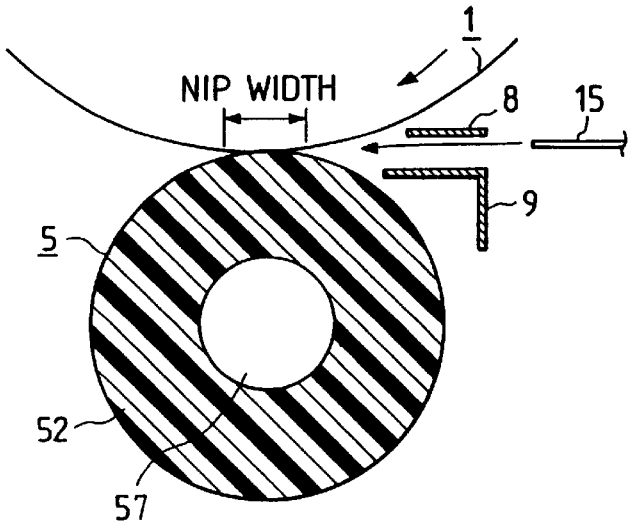
FIGS. 3A, 3B, 3C and 3D are schematic cross-sectional views illustrating comparative samples for the first embodiment of the present invention.
Figure 3B:
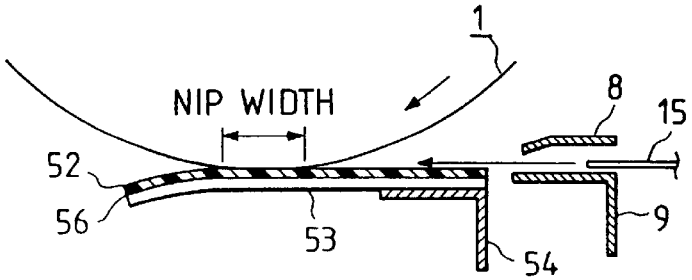
Figure 3C:
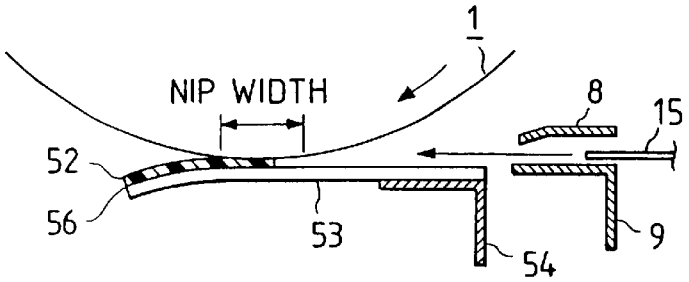
Figure 3D:
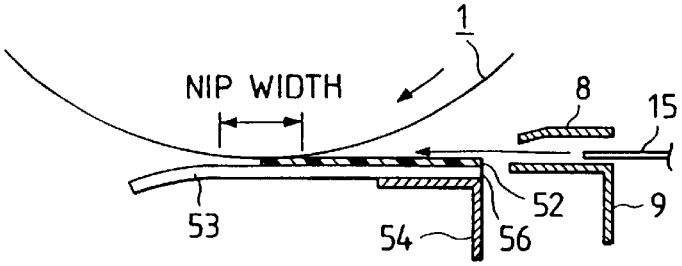

The transfer material conveying path near the transfer position may preferably be a substantially straight path as shown in FIG. 2 in order to stabilize the transfer material conveying property. Also, in the present embodiment, there is adopted a simple construction in which a plate-like transfer charging member is mounted on a sheet-like member, and therefore it is possible to make the member easily as compared with a roller, and the transfer of a highly minute image of 1200 dpi or so can be realized at a low cost. Further, the use of a resilient member makes the close contact between the drum and the transfer sheet good, and makes it possible to obtain a good image free of transfer irregularity.

The present embodiment has been described with respect to an example in which the transfer charging member bears against the drum and is held, but a similar effect is also obtained when the transfer charging member is not in contact with but in proximity to the drum at an interval less or greater than the thickness of the sheet.

(Second Embodiment)

Figure 5A:
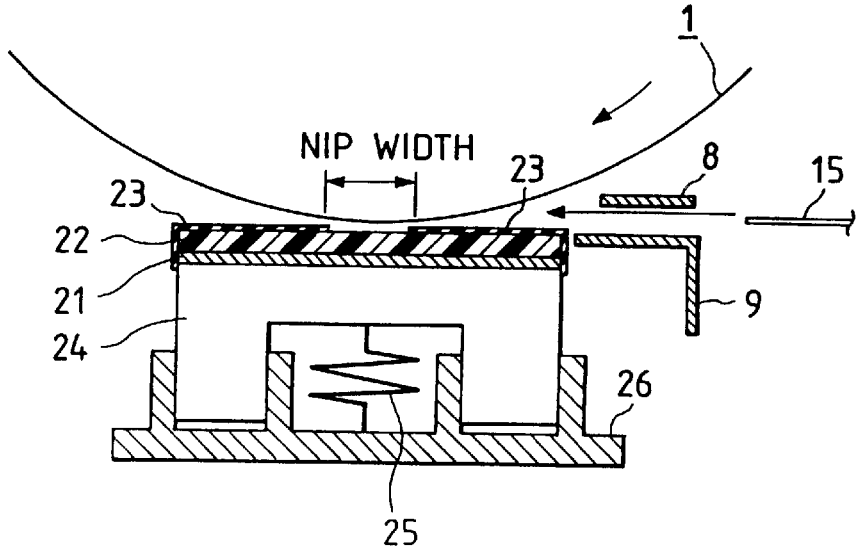
FIGS. 5A and 5B are schematic cross-sectional views illustrating a second embodiment of the present invention.
Figure 5B:
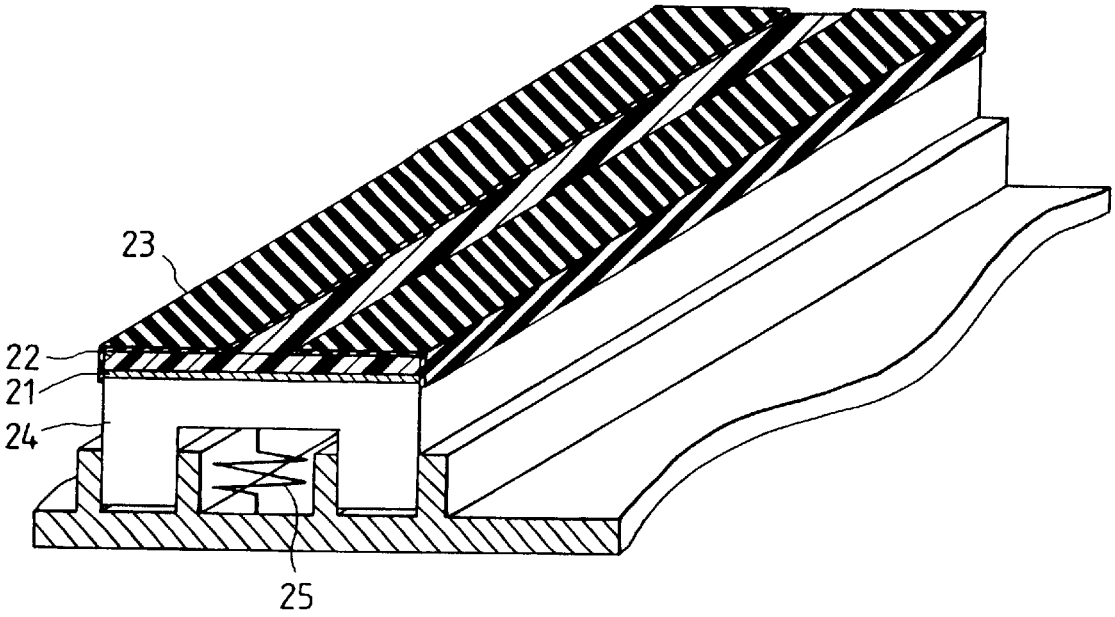

Description will now be made of a second embodiment of the transfer apparatus which can be used in the image forming apparatus of FIG. 2. FIG. 5A shows a cross-sectional view of a transfer charging member which is the second embodiment, and FIG. 5B shows a perspective view thereof.

In the present embodiment, an elastic tape 22 of medium resistance formed of urethane of a thickness 500 to 600 μm having carbon or the like dispersed therein and resistance-adjusted to $10^5$ to $10^9$ Ω is stuck on an electrically conductive plate 21 comprising a metallic electrode plate or an SUS plate having a thickness of 500 μm, and an insulating layer 23 is provided on the area before and behind the nip portion. The transfer charging member is provided with the electrically conductive plate 21 and the elastic tape 22 and can contact with the back side of transfer sheet. The reference numeral 24 designates an insulative holding member of ABS (acrylonitrile-butadiene-styrene) resin, POM (polyacetal) material or the like for holding the transfer charging member comprising the electrically conductive plate 21 and the medium resistance elastic tape 22 in opposed relationship with the photosensitive drum, and the insulative holding member 24 has one end thereof fixed to the bottom surface 26 of the image forming apparatus body by a pressing member (pressing spring) 25 and is designed to be pressed toward the drum. The electrically conductive plate 21 is connected to a power source (not shown), and a predetermined transfer bias is applied thereto. The exposed portion of the transfer charging member (the portion which is not covered with the insulating layer 23) is provided within the width of contact between the drum and the transfer material in the direction of movement of the transfer material.

With such a construction, the transfer electric field can be sharply regulated by the insulating layer 23 with a result that the area for imparting charges to the back of the sheet can be made narrower than the nip portion, so that a good image free of bad transfer problems such as splash and explosion can be obtained. Also, since an elastic member such as the medium resistance elastic tape is used, the close contacting property with the drum and the transfer sheet is good and a good image free of transfer irregularity can be obtained. The insulating layer 23 can guide the transfer sheet to the nip portion.

Figure 6:
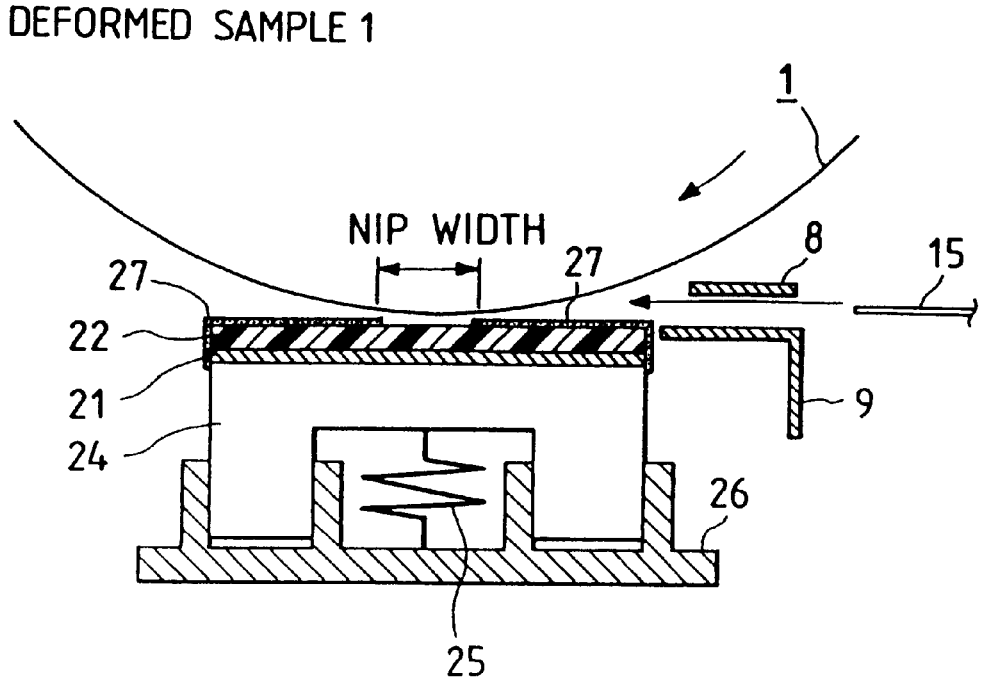
FIG. 6 is a schematic cross-sectional view illustrating a deformed sample or modification of the second embodiment of the present invention.

FIG. 6 shows a deformed sample or modification 1 of the second embodiment of the transfer apparatus. In this modification 1, an insulative tape 27 such as a silicon tape or a polyamide tape of which the frictional charging characteristic is positive is stuck instead of the insulating coat layer 23 shown in FIG. 5 (the frictional charging characteristic being positive is a characteristic that in the charging by friction, one is charged to plus and the partner contacting with the one is charged to minus).

With such a construction, it becomes possible to improve the quality of image further. That is, a member of which the charging characteristic is positive is used in the portion upstream of the nip portion, whereby minus charges are imparted to the back of the transfer sheet by the frictional charging of the insulating layer 23 guiding the transfer sheet while the transfer sheet is conveyed to the transfer area (the nip portion), and in the transfer area, the electric field becomes sharper, so that the quality of image such as splash is improved. Also, even if in the portion downstream of the nip portion, minus charges are imparted to the back side of the transfer material, the unfixed image on the transfer material may not be disturbed as a state in which plus charges are left on the back side of the transfer material.

In the case of any other transfer material such as a silicon tape of which the charging characteristic is at the positive end than transfer sheet, it is possible to impart negative charges. It is in the case of the transfer of a negative toner by reverse development that as in the present modification, a member of positive charging characteristic is used, and in the case of the transfer by a positive toner, a Teflon tape or the like of which the charging characteristic is negative can be used to obtain a similar effect.

Figure 7:
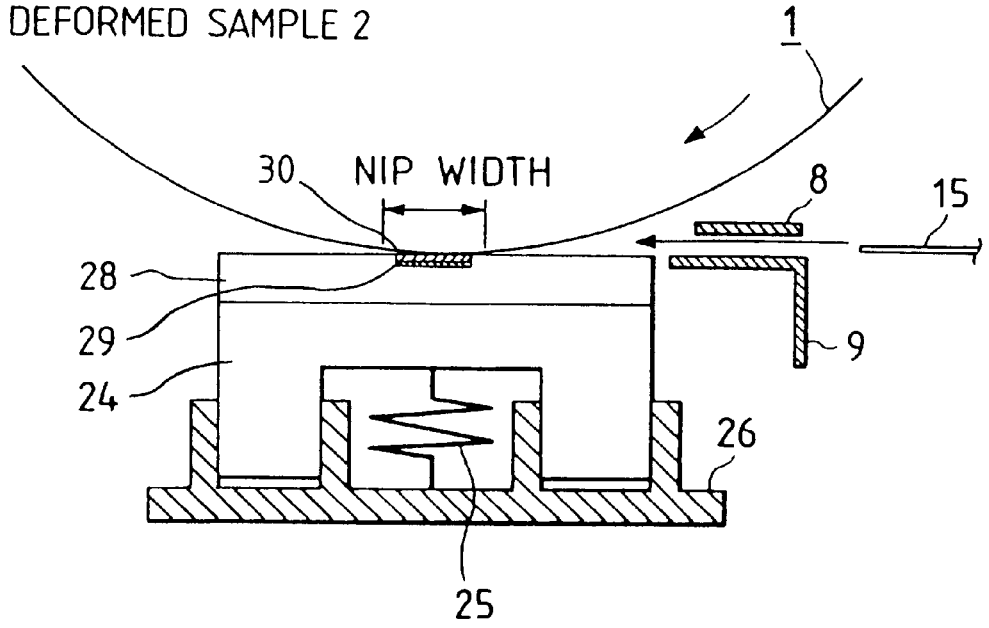
FIG. 7 is a schematic construction view illustrating a further modification of the second embodiment of the present invention.

FIG. 7 shows modification 2 of the second embodiment. In this modification 2, the portion comprised of the electrically conductive plate 21, the medium resistance tape 22 and the insulating layer 23 in the above-described modification has been changed. The reference numeral 28 denotes an insulative plate of a thickness 2 to 4 mm having a groove of a width 0.5 to 2 mm for an electrode in the nip portion, and a power supplying portion (electrode portion) 29 such as electrically conductive paste is embedded in this groove, and it is coated with a medium resistance layer 30 to thereby constitute a transfer charging member. As in the second embodiment, this transfer charging member is held so as to be pressed toward the drum by the holding member 24 and the pressing member 25. A material such as silicone rubber of which the charging characteristic is positive can be used for the insulative plate 28 to thereby obtain the same effect as that of modification 1 shown in FIG. 6.

The result of image evaluation effected regarding each member as the confirmation of the effect under low-temperature and low-humidity environment as in the case of the first embodiment is shown in the table of FIG. 8. As can be seen from this table, the transfer apparatus is constructed like the present embodiment, whereby the portion for imparting charges to the back of the sheet can be made narrower than the contact nip between the transfer sheet and the drum. As a result, even under low-temperature and low-humidity environment, it becomes possible to obtain a good image free of explosion and splash. Also, a member of which the charging characteristic is positive (in the case of a negative toner) can be provided on that portion of the transfer member which frictionally contacts with the sheet before the nip portion, thereby further improving the quality of image.

(Third Embodiment)

Figure 9A:
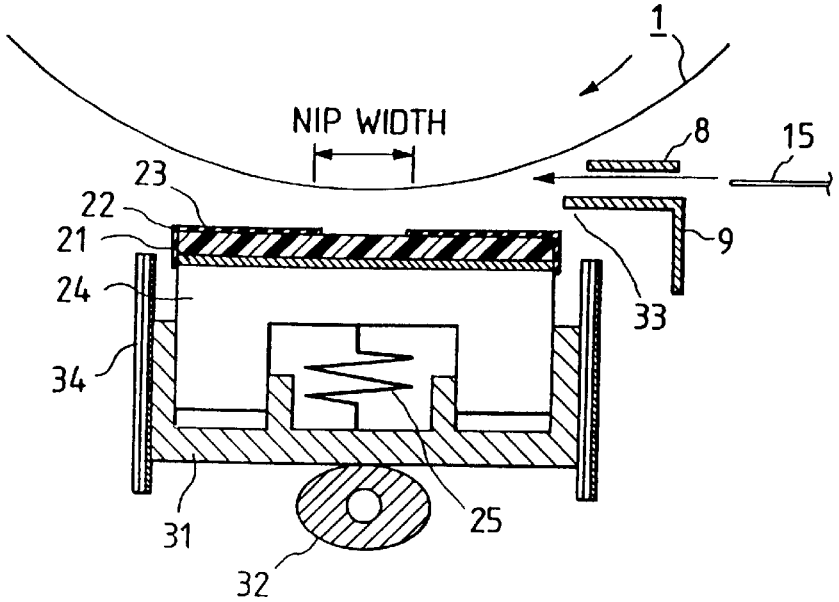
FIGS. 9A and 9B are schematic cross-sectional views illustrating a third embodiment of the present invention.
Figure 9B:
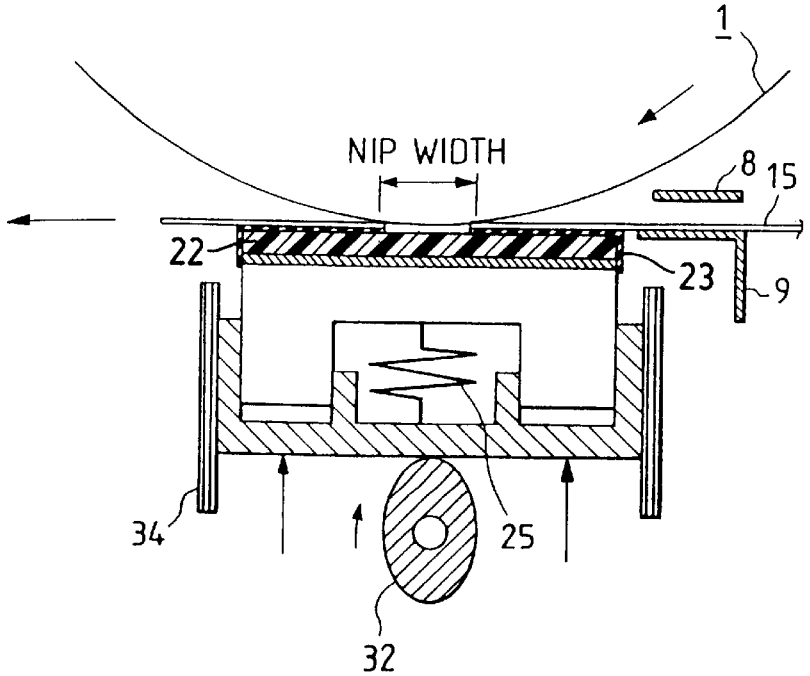

FIGS. 9A and 9B show a third embodiment of the present invention. According to this embodiment, in the transfer apparatus (21 to 25) used in the second embodiment, a fixing member 31 movable toward the drum and an elliptical roller 32 for moving the fixing member 31 toward the drum by rotation are disposed on a bearing surface, and a transfer charging member is caused to bear against the drum (FIG. 9B) or is moved away from the drum (FIG. 9A) by the sheet detection by a sheet detecting member 33. The detecting member may be an optical sensor.

The reference numeral 31 designates a transfer apparatus fixing member formed of ABS resin, POM material or the like and held for movement toward and away from the drum by a rail 34. The transfer apparatus fixing member 31 is connected to the transfer member by a spring 25 and a holder 24, and is designed such that when it bears against the drum, predetermined bearing pressure is always obtained relative to the drum. The reference numeral 32 denotes a cam roller member formed of ABS resin, POM material or the like and connected to a drive motor (not shown), and when the sheet detecting member 33 detects sheet, the cam roller member 32 is rotated by an amount corresponding to ¼ of one full rotation in timed relationship with the arrival of the sheet at the nip portion, and pushes up the transfer member toward the drum along the rail and bears against the drum. When the sheet passes the nip portion, the cam roller member is further rotated by an amount corresponding to ¼ of one full rotation and the transfer member is moved away from the drum.

With such a construction, even under low-temperature and low-humidity environment, there can be obtained a good image free of bad transfer problems such as explosion and also, the contact between the transfer member and the drum can be prevented during the non-supply of sheet. Thus, it becomes possible to mitigate the scrape or the like of the transfer member due to the friction between the drum and the transfer member, and improve the durability thereof. Also, the transfer member is in a non-contact relationship with the drum during the non-supply of sheet and therefore, it becomes advantageous against the contamination by fogging toner or unremoved toner.

(Fourth Embodiment)

Figure 10:
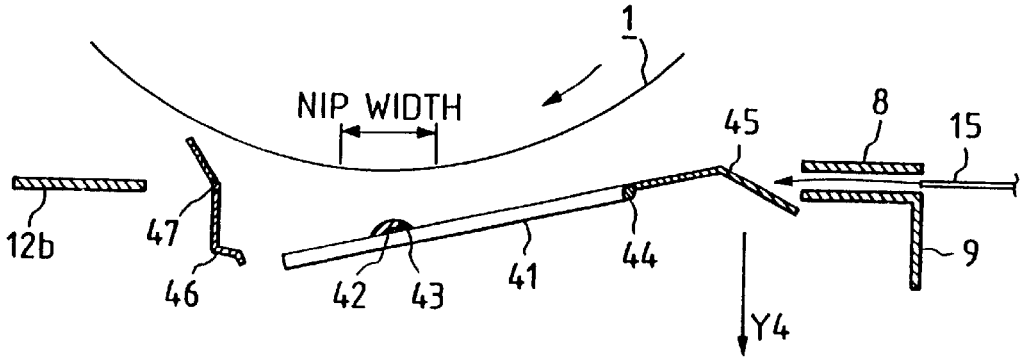
FIG. 10 is a schematic cross-sectional view illustrating a fourth embodiment of the present invention.

FIG. 10 shows a fourth embodiment of the transfer apparatus. This embodiment is designed such that the coming of transfer sheet is detected and the gravity of the sheet is utilized to cause the transfer charging member to bear against the photosensitive drum. The same reference characters as those already described designate the same members or functionally similar members.

The reference numeral 41 denotes a film-like electrode holding member holding a transfer charging member comprising an electrode 42 and a medium resistance member 43, and held for movement toward the drum with a fulcrum 44 as an axis. The holding member 41 is used also as a guide member for guiding transfer sheet to the transfer position. The reference numerals 45 and 46 designate members serving as both a sheet detecting member and a film holding member, and formed of POM material or the like. It is disposed in the portions upstream and downstream of the transfer portion, respectively, and adapted to be operated by the gravity of sheet (the member 45 is made integral with a transfer sheet 41 through the fulcrum 44, and the member 46 is rotatable about a fulcrum 47 to thereby hold film).

The operation when the sheet has been conveyed to the transfer portion will hereinafter be described with reference to FIGS. 11A, 11B, 11C, 11D and 11E.

Figure 11A:
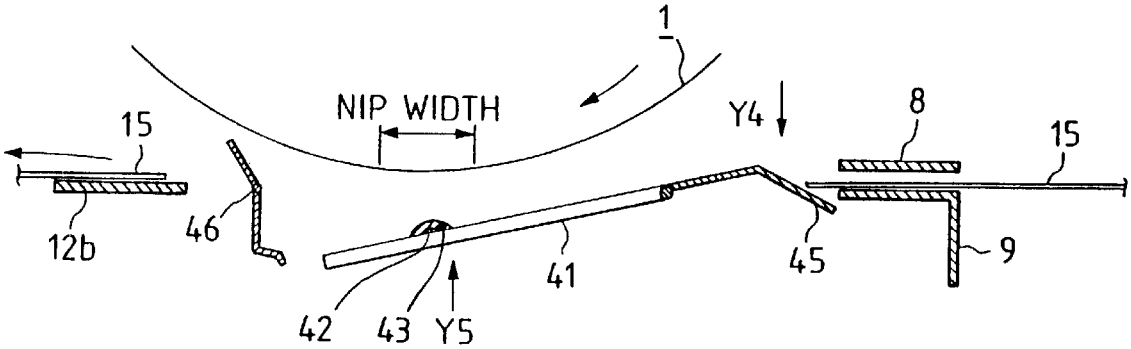
FIGS. 11A, 11B, 11C, 11D and 11E are schematic cross-sectional views illustrating the operation of the fourth embodiment of the present invention.
Figure 11B:
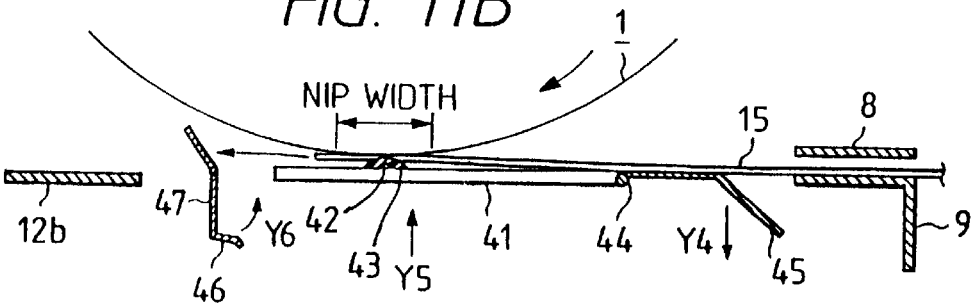
Figure 11C:
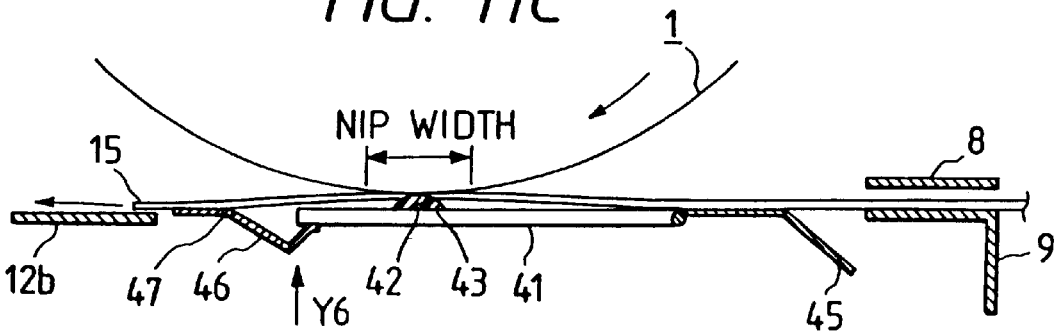
Figure 11D:
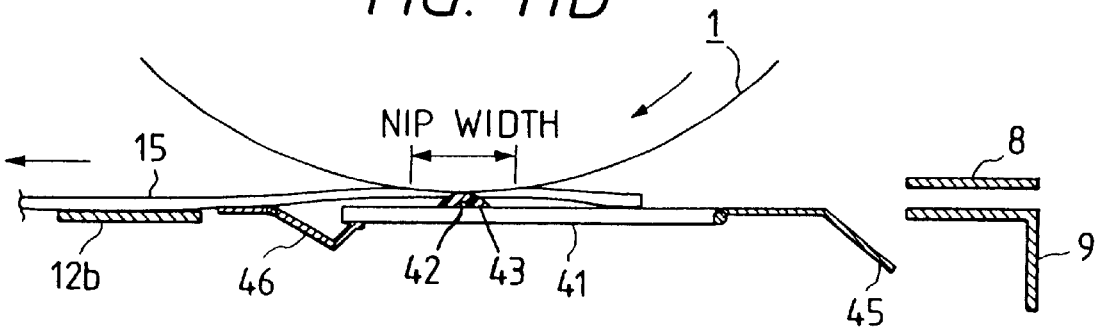
Figure 11E:
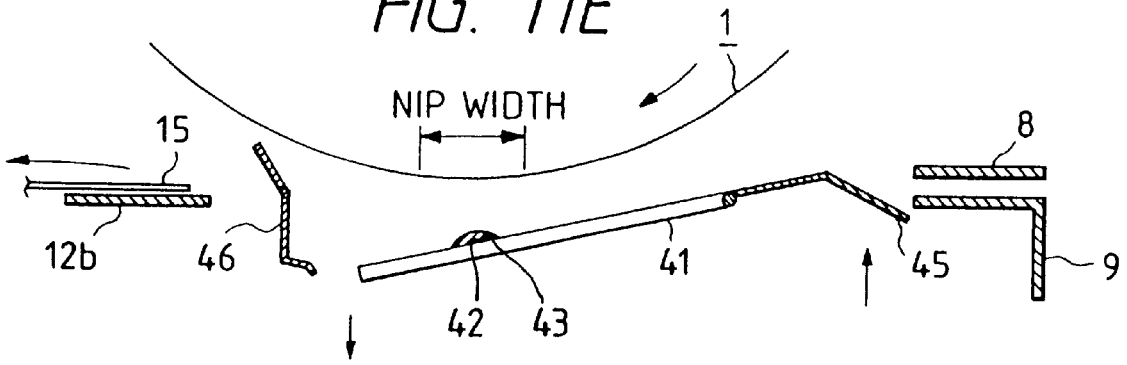

When the transfer sheet 15 is conveyed from the transfer guide portion to the sheet detecting member 45 by a sheet supply roller (not shown), the sheet detecting member 45 is pushed in the direction of arrow Y4 by the gravity of the sheet and simultaneously therewith, the transfer film 41 connected to the sheet detecting member 45 through the fulcrum 44 is pushed in the direction of arrow Y5 and is urged against the drum (FIGS. 11A and 11B). In synchronism with the arrival of the leading end of the sheet at the transfer area, a predetermined application bias is applied to the electrode 42 by an external power source (not shown), and transfer is sequentially effected. When the sheet arrives at the sheet detecting member 46 in the downstream portion, the sheet detecting member 46 is pushed in the direction of arrow Y6 by the gravity of the sheet, and is held so as to urge the downstream side end portion of the transfer film (holding member) 41 toward the drum (FIG. 11C). This state is continued until the sheet passes the transfer electrode portion and passes the sheet detecting member 46. That is, even when the transfer sheet 15 passes over the sheet detecting member 45 and the pressing toward the sheet detecting member 45 is released, the transfer film 41 remains urged toward the drum by the sheet detecting member 46 (FIG. 11D). When the transfer sheet 15 passes over the sheet detecting member 46, the pressure by the gravity of the sheet is released to return the transfer film 41 and the sheet detecting members 45, 46 to their original positions (FIG. 11E).

With such a construction, the contact between the transfer member and the drum can be prevented during the non-supply of sheet which is the sheet interval when an image is continuously formed on a plurality of sheets of transfer sheet by the inputting of an image forming start signal from the outside. Thus it becomes possible to mitigate the scrape or the like by the friction between the drum and the transfer charging member, and to thereby improve the durability thereof. Also, during the non-supply of sheet, the drum and the transfer member are in non-contact with each other and therefore, the transfer member becomes advantageous against the contamination due to fogging toner or unremoved toner. Further, the contact of the transfer member with the drum is effected by the utilization of the gravity of the sheet, so that the construction can be simplified and a reduction in costs becomes possible.

Figure 12A:
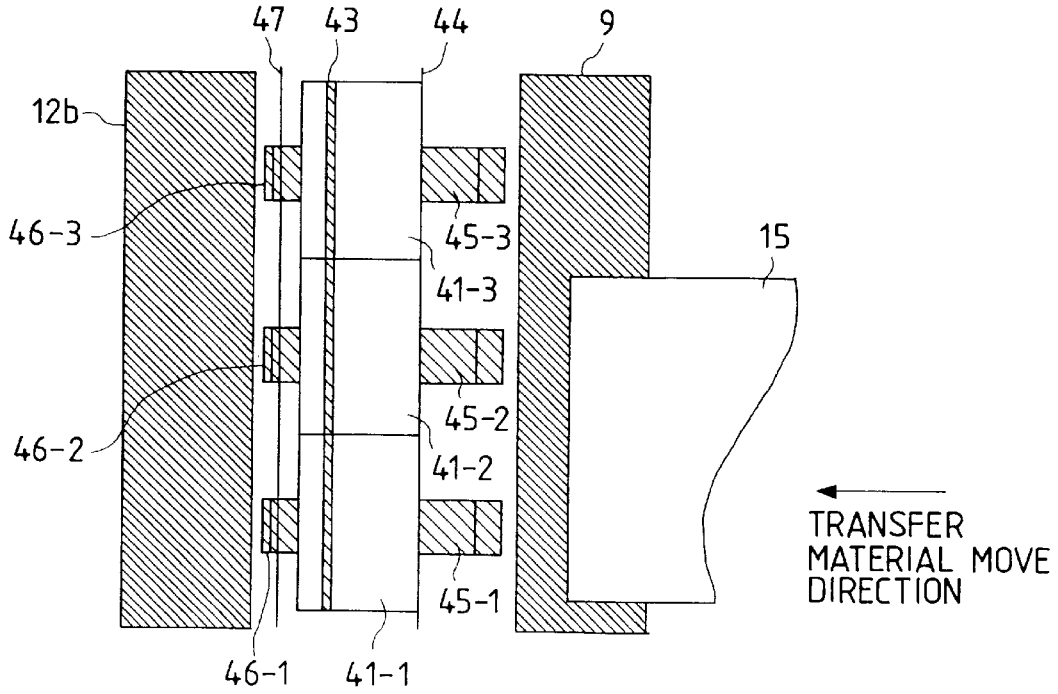
FIGS. 12A, 12B and 12C are schematic cross-sectional views illustrating a modification of the fourth embodiment of the present invention.
Figure 12B:
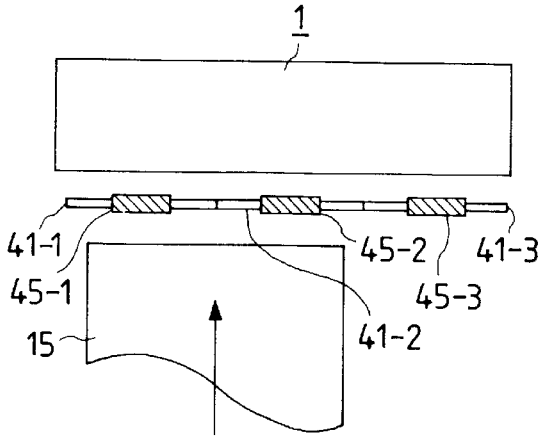
Figure 12C:
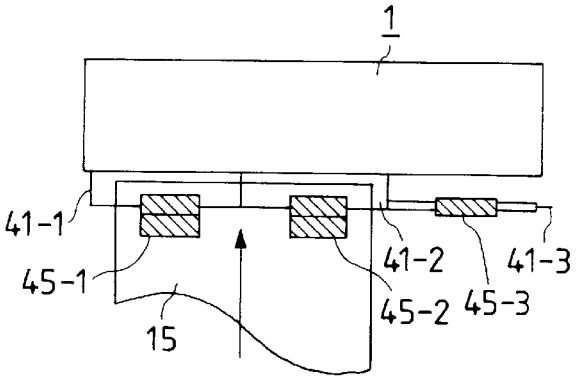
Figure 15:
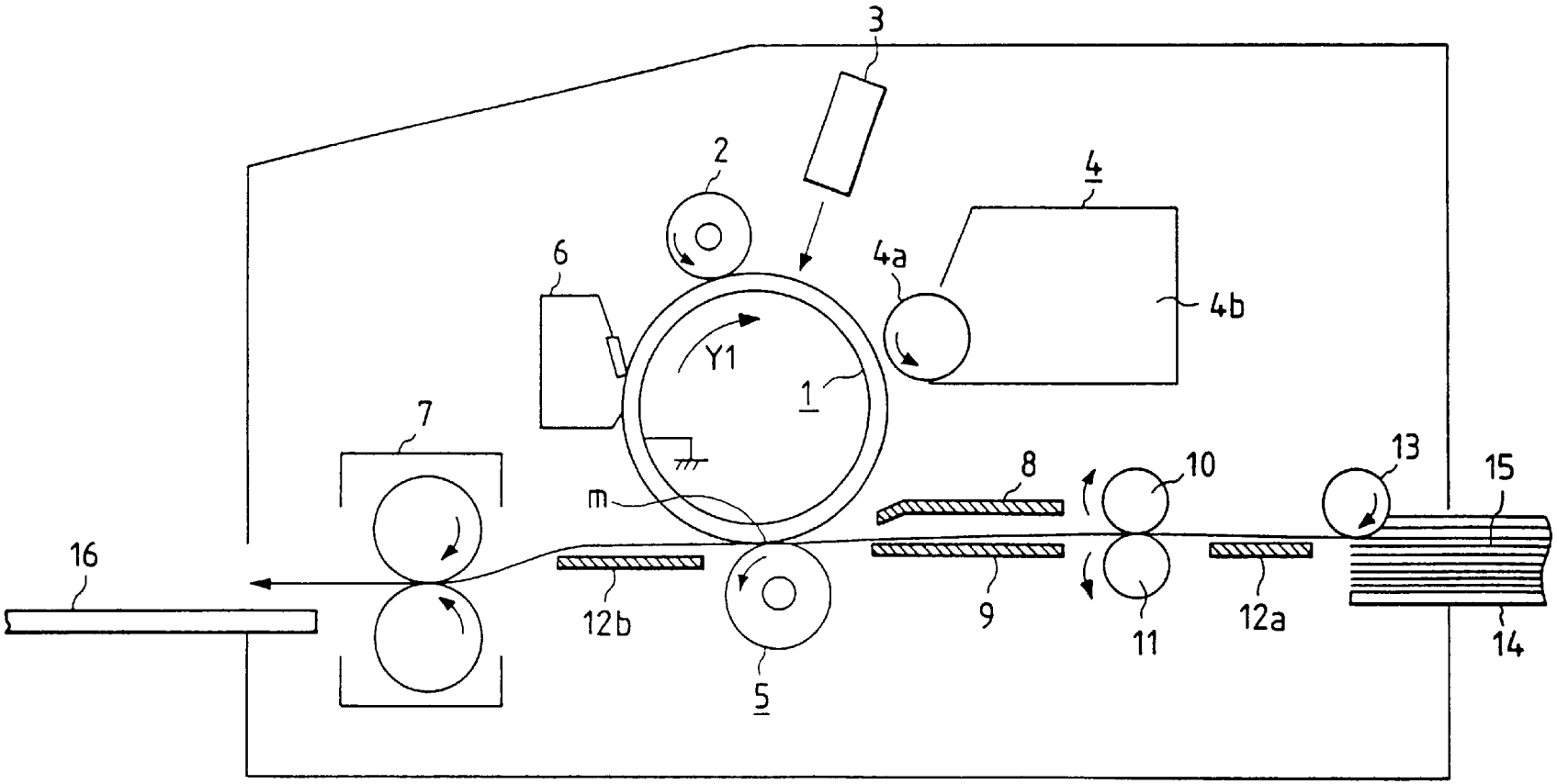
FIG. 15 PRIOR ART
FIG. 15 is a schematic cross-sectional view showing an example of the prior art.

FIGS. 12A, 12B and 12C show a modification of the fourth embodiment. FIG. 12A is a view of the transfer charging member and the transfer guide as they are seen from the upper portion thereof, and this construction has three transfer sheets 41-1, 41-2 and 41-3, and sheet detecting members 45-1, 45-2, 45-3, 46-1, 46-2 and 46-3 for respective ones of the transfer sheets. These are uniquely (discretely) operable and each of them detects the sheet and operates as shown in FIGS. 11A, 11B, 11C, 11D and 11E. FIGS. 12B and 12C are views of the transfer member and the photosensitive drum as they are seen from the upper portion upstream with respect to the direction of movement of the transfer sheet, and show the operative state when transfer sheet of a different width is supplied. FIG. 12B shows the sheet non-supply state in which the drum and the transfer sheets are in non-contact with each other. When transfer is to be effected onto sheet of an ordinary (maximum) size, all of the sheet detecting members 45-1, 45-2 and 45-3 detect the sheet and the transfer sheets 41-1, 41-2 and 41-3 bear against the drum. On the other hand, when as shown in FIG. 12C, transfer is to be effected onto a sheet of a small size, only the sheet detecting members 45-1 and 45-2 detect the sheet and only the transfer sheets 41-1 and 41-2 bear against the drum, whereby transfer is effected.

With such a construction, when transfer is to be effected onto transfer sheet of a different size, to effect automatically change over the size, and it becomes possible to effect stable transfer by a simple construction.

In the present embodiment, use is made of a transfer sheet divided into three sheets of the same type, and description has been made of transfer sheet of two kinds of sheet sizes, but depending on the sheet size or the like used, the size and number of transfer sheets can be suitably set in accordance with what is suitable therefore.

(Fifth Embodiment)

FIG. 13A shows a cross-sectional view of a transfer apparatus which is a fifth embodiment of the present invention, and FIG. 13B shows a perspective view thereof.

In this embodiment, a photosensitive belt is used as the image bearing member so that the nip width can be secured greatly even in a transfer member of relatively high rigidity. The reference numeral 81 designates a photosensitive belt having an electrically conductive base body formed of aluminum or the like, and a photoconductive layer formed, for example, of an organic photoconductive material covering the outer peripheral surface thereof, and rotatively driven in the direction of arrow Y9 by a drive roller 82 and driven rollers 83, 84. The reference numeral 85 denotes the transfer apparatus comprising a base body 86 of ABS resin or POM material or the like, and an electrode portion 87 of medium resistance formed in the nip with the photosensitive belt by printing. This transfer apparatus 85 is designed to bear against the photosensitive belt 81 by a pressing member or the like (not shown). The upstream portion and downstream portion of the base body 86 which are not used as an electrode portion can be extended in the direction of sheet conveyance or inclined so as to serve also as a transfer guide.

As a result of image evaluation effected by the use of the above-described transfer member under low-temperature and low-humidity environment as in the first embodiment, there was obtained a good image free of explosion and splash, as compared with the transfer roller. A case where the process speed was changed was also compared with the transfer roller and image evaluation was effected. FIG. 14 shows a table of the results of these evaluations. The transfer member of the present embodiment permits the nip width to be secured greatly as compared with the roller of comparative sample 1 even when the process speed is heightened so that the charge imparting time during transfer can be made long. Thus, even when the process speed is made higher, a good quality of image can be realized without bad transfer being encountered.

As described above, by adopting the present construction, bad transfer such as splash and explosion can be prevented and a good quality of image can be realized even when the process speed is made higher. While herein, medium resistance has been expressed as the resistance value of the transfer charging member and the resistance between the transfer surface and the power supply contact has been described as $10^6$ to $10^9$ Ω, transfer is possible by a transfer charging member of photoconductivity or of high resistance approximate to insulation, and the above-mentioned range is not particularly restrictive.

As described above, by using the transfer apparatus of the present invention, it becomes possible to supply charges to the back side of the transfer material within the width of contact between the transfer material and the image bearing member, and the transfer electric field can be narrowed and bad images such as splash and explosions can be prevented. Also, the sheet-like or plate-like transfer charging member facilitates the making of the member, so that transfer means good in image splash and resolvability can be realized at a low cost. On the other hand, an ON/OFF mechanism is provided for the transfer charging member, whereby the contact between the transfer charging member and the image bearing member can be prevented during the non-supply of sheets and as a result, the scraping or the like due to friction can be mitigated and the durability can be improved. The present invention is also advantageous against the contamination by fogging toner or unremoved toner or the like.

What is claimed is:

1. An image transfer apparatus comprising:

a transfer charging member for transferring a toner image from an image bearing member to a transfer material, said transfer charging member being adapted to contact with a surface of the transfer material conveyed between said image bearing member and said transfer charging member opposite to a surface thereof facing the image bearing member; and a guide member for supporting said transfer charging member to guide the transfer material between said image bearing member and said transfer charging member, a guide surface for guiding the transfer material of said guide member extends straight in a moving direction of said image bearing member in a contact area between said image bearing member and the transfer material;

wherein said transfer charging member is disposed within the contact area between said image bearing member and the transfer material in the direction of movement of the transfer material.

2. An image transfer apparatus according to claim 1, wherein said transfer charging member is provided with an electrode portion and a resistance layer disposed nearer to said image bearing member than said electrode portion.

3. An image transfer apparatus according to claim 2, wherein the volume resistivity of said resistance layer is $10^4$ to $10^{13}$ Ωcm.

4. An image transfer apparatus according to claim 1, wherein said transfer charging member is plate-like shape.

5. An image transfer apparatus according to claim 1, wherein said guide member is a film.

6. An image transfer apparatus according to claim 1, wherein said transfer charging member is formed by a printing.

7. An image transfer apparatus according to claim 1, wherein said transfer charging member is capable of contacting with said image bearing member.

8. An image transfer apparatus according to claim 1, further comprising a detecting member for detecting the transfer material, and wherein said transfer charging member moves toward or away from said image bearing member in conformity with the result of the detection by said detecting member.

9. An image transfer apparatus comprising:

a transfer charging member for transferring a toner image from an image bearing member to a transfer material, said transfer charging member being adapted to contact with a surface opposite to that surface of the transfer material conveyed between said image bearing member and said transfer charging member opposite to a surface thereof facing said image bearing member; and an insulating member covering a portion of a surface of said transfer charging member opposed to said image bearing member, and guiding the transfer material to between said image bearing member and said transfer charging member, a guide surface for guiding the transfer material of said insulating member extends straight in a moving direction of said image bearing member in a contact area between said image bearing member and the transfer material;

wherein an exposed portion of said transfer charging member not covered with said insulating member is disposed within the contact area between said image bearing member and the transfer material in the direction of movement of the transfer material.

10. An image transfer apparatus according to claim 9, wherein said transfer charging member is provided with an electrode portion and a resistance layer disposed nearer to said image bearing member than said electrode portion.

11. An image transfer apparatus according to claim 10, wherein the volume resistivity of said resistance layer is $10^4$ to $10^{13}$ Ωcm.

12. An image transfer apparatus according to claim 9, wherein said transfer charging member is plate-like shape.

13. An image transfer apparatus according to claim 9, wherein said insulating member is a film.

14. An image transfer apparatus according to claim 9, wherein said transfer charging member is formed by printing.

15. An image transfer apparatus according to claim 9, wherein said transfer charging member is capable of contacting with said image bearing member.

16. An image transfer apparatus comprising:

a transfer charging member for transferring a toner image from an image bearing member to a transfer material, said transfer charging member being adapted to contact with a surface opposite to that surface of the transfer material conveyed between said image bearing member and said transfer charging member opposite to a surface thereof facing to said image bearing member; and an insulating member covering a portion of a surface of said transfer charging member opposed to said image bearing member, and guiding the transfer material between said image bearing member and said transfer charging member;

wherein an exposed portion of said transfer charging member not covered with said insulating member is disposed within a contact area between said image bearing member and the transfer material in the direction of movement of the transfer material, and wherein said insulating member is capable of contacting with a surface of the transfer material opposite to a surface thereof facing said image bearing member, and is having a frictional charging characteristic of the same polarity as a transfer voltage applied to said transfer charging member relative to the transfer material.

* * * * *

UNITED STATES PATENT AND TRADEMARK OFFICE

CERTIFICATE OF CORRECTION

PATENT NO. : 5,918,096

DATED : June 29, 1999

INVENTOR(S): TETSUYA SANO, ET AL.

It is certified that error appears in the above-identified patent and that said Letters Patent is hereby corrected as shown below:

COLUMN 1,
Line 26, "a relationship" should read --in a noncontact relationship--; and
Line 62, "fixting" should read --fixing--.

COLUMN 2,
Line 2, "fixting" should read --fixing--;
Line 17, "fixted" should read --fixed--;
Line 32, "an" should read --a--;
Line 38, "unfixted" should read --unfixed--; and
Line 65, "view" should read --views--.

COLUMN 4,
Line 26, "fixting" should read --fixing--; and
Line 27, "fixting" should read --fixing--.

COLUMN 5,
Line 15, "terephthalate" should read --terephthatate--; and
Line 54, "done" should read --done.--.

COLUMN 6,
Line 36, "problems" should be deleted; and
Line 39, "transfer" should read --transfer problems--.

UNITED STATES PATENT AND TRADEMARK OFFICE

CERTIFICATE OF CORRECTION

PATENT NO. : 5,918,096

DATED : June 29, 1999

INVENTOR(S): TETSUYA SANO, ET AL.

It is certified that error appears in the above-identified patent and that said Letters Patent is hereby corrected as shown below:

COLUMN 12,
Line 38, "to" should be deleted.

COLUMN 13,
Line 8, "to" should be deleted.

Signed and Sealed this

Sixth Day of June, 2000

*Attest:*

*Attesting Officer*

Q. TODD DICKINSON

*Director of Patents and Trademarks*